US007168215B1

(12) United States Patent
Bednarczyk

(10) Patent No.: US 7,168,215 B1
(45) Date of Patent: Jan. 30, 2007

(54) SLATE LAYING SYSTEM

(76) Inventor: January Lech Bednarczyk, 12 Julien Road, Ealing, London W5 4XA (GB)

( * ) Notice: Subject to any disclaimer, the term of this patent is extended or adjusted under 35 U.S.C. 154(b) by 48 days.

(21) Appl. No.: 10/432,209

(22) PCT Filed: Oct. 17, 2000

(86) PCT No.: PCT/GB00/03980

§ 371 (c)(1),
(2), (4) Date: May 22, 2003

(87) PCT Pub. No.: WO02/33192

PCT Pub. Date: Apr. 25, 2002

(51) Int. Cl.
*E04D 1/34* (2006.01)

(52) U.S. Cl. ..... 52/478; 52/489.2; 52/551

(58) Field of Classification Search ..... 52/551, 52/543, 544, 478, 489.1, 489.2, 548, 747.12, 52/748.1, 710, 550, 539, 520, 536
See application file for complete search history.

(56) References Cited

U.S. PATENT DOCUMENTS

| | | | | | |
|---|---|---|---|---|---|
| 1,537,952 | A | * | 5/1925 | Boyle et al. | 52/548 |
| 3,646,717 | A | * | 3/1972 | Parker | 52/548 |
| 4,958,471 | A | * | 9/1990 | Waddington | 52/546 |
| 5,577,360 | A | * | 11/1996 | Gibbs | 52/518 |
| 5,617,690 | A | * | 4/1997 | Gibbs | 52/518 |
| 5,642,596 | A | * | 7/1997 | Waddington | 52/546 |
| 5,791,112 | A | * | 8/1998 | Plum | 52/551 |
| 5,794,396 | A | * | 8/1998 | Gibbs | 52/518 |
| 6,052,961 | A | | 4/2000 | Gibs | |

FOREIGN PATENT DOCUMENTS

| | | | |
|---|---|---|---|
| DE | 827 248 C | | 1/1953 |
| DE | 196 47 528 C | | 5/1998 |
| FR | 2 562 591 | * | 10/1985 |
| GB | 137185 | | 3/1919 |
| GB | 158341 | | 12/1919 |
| GB | 197 584 A | | 5/1923 |
| GB | 2 172 620 | * | 9/1986 |
| GB | 2 197 002 A | * | 5/1988 |
| GB | 2202245 A | | 9/1988 |
| GB | 2325679 A | | 5/1990 |
| GB | 2 348 894 A | * | 10/2000 |
| GB | 2 360 541 A | * | 9/2001 |

* cited by examiner

*Primary Examiner*—Robert Canfield
(74) *Attorney, Agent, or Firm*—Weiner & Burt, P.C.; Irving M. Weiner; Pamela S. Burt

(57) ABSTRACT

The slating of a new roof or the re-slating of an existing roof is carried out by attaching batten rails to the roof, and providing a clip for attachment to the underside of a slate that is to be mounted thereon. The batten rail and the clip mechanically interlock so as to secure the slate to the building.

7 Claims, 3 Drawing Sheets

SLATE LAYING SYSTEM

This invention relates to a slate laying system and method of laying slates, for a roof or facade of a building, in respect of new roofs and facades or the re-slating of existing roofs or facades.

Conventional systems for fixing slates are time consuming and often result in breakages of the slates when they are secured to battens by hammering of nails thereto. Furthermore, once a slate has been nailed in place it cannot then be adjusted into a better position with respect to adjacent slates.

It is an object of the present invention to provide a slate laying system and method of laying slates that overcomes or at least alleviates known disadvantages.

In accordance with one aspect of the present invention there is provided a slate laying system for a roof or facade of a building, comprising an elongate batten rail for attachment to a building support member, and a clip for attachment to the underside of a slate, wherein the batten rail and the clip comprise a mechanical interlocking arrangement which enables the slate to be secured to the building.

Advantageously, the interlocking arrangement between the clip and the rail is such that a groove extends along the rail and a tongue is provided on the clip, which preferably is resilient, for engagement with the groove of the rail. Preferably, the groove extends along the underside of the batten rail, and, with the clip arranged to be attached to the underside of the slate, the tongue thereof may project upwardly. This interlocking arrangement thus allows adjustment of the positioning of the slate on the roof, by sliding the clip along the batten rail.

It is also preferred that the clip has raised projections so as to grip the underside of the slate thereby to prevent rotation or slipping of the slate relative to the clip.

Advantageously, the clip is made of a resilient material, or may alternatively be resiliently mounted onto the slate, so that the interlocking engagement with the batten rail can be a snap fit.

In accordance with a further aspect of the present invention, there is provided a method of laying slates on a roof or facade of a building, comprising: attaching an elongate batten rail to a building support member; attaching a clip to a slate; and attaching the slate to the batten rail by means of the clip, the batten rail and the clip comprising a mechanical interlocking arrangement which enables the slate to be secured to the building.

It will be appreciated that the method of laying slates may utilise the slate laying system of the first aspect of the invention.

The mechanical interlocking provided by the present invention does not need the slates to be hammered into place, and advantageously the slates may be clicked on to the batten rails and slid along to butt against an adjacent slate, without the use of nails.

Once the batten rails have been screwed into place on existing rafters or other fixed battens of the building, the entire roof or facade of slates can be laid continuously in a short length of time. If subsequently it is required to replace a broken slate, they are easily individually removed with a slate hook and a replacement slate, with its clip attached thereto, can easily be fitted.

It is envisaged that the present invention may be used to slate or re-slate sloping roofs or walls of buildings, as well as substantially vertical walls.

It will be appreciated that reference herein to "slate" is not to be understood as a restriction to the material of the article, but rather indicative of the function that it is to carry out, in providing the finishing layer of a roof or facade of a building. Thus, for example, slate is intended also to encompass a tile or other roof or facade member.

A slate laying system and a method of laying slates, each in accordance with the present invention, will now be described, by way of example, with reference to the accompanying drawings in which.

Figure 3A:
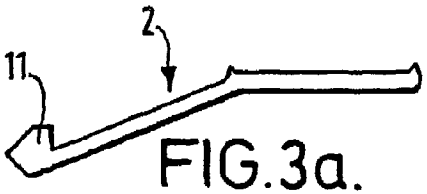
Figure 3B:
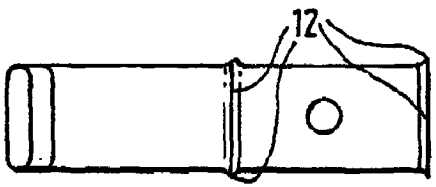
Figure 4:
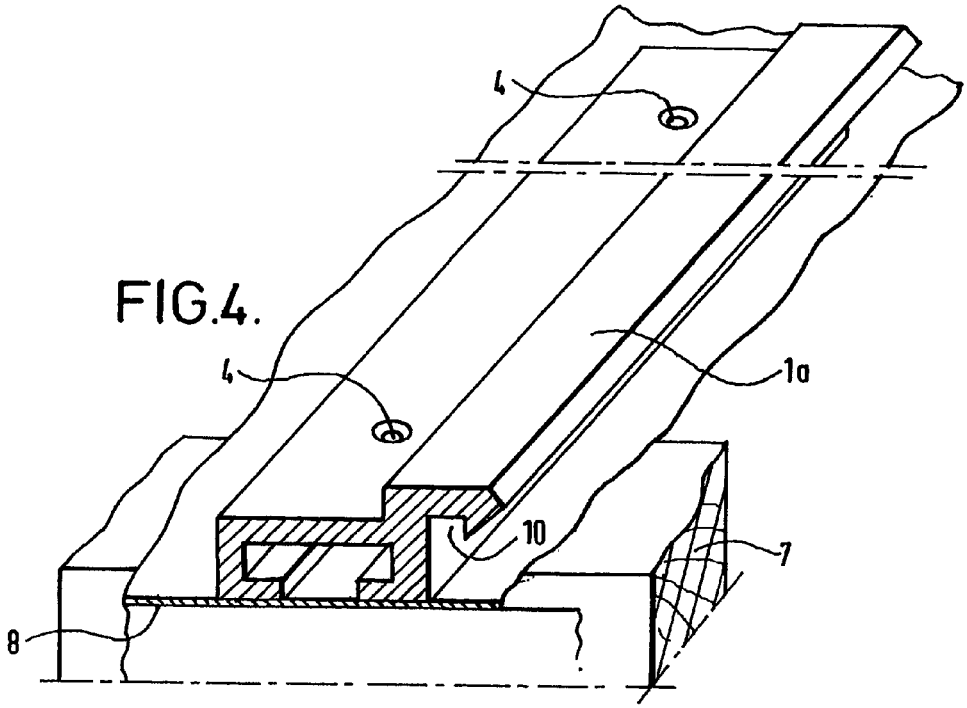
Figure 5:
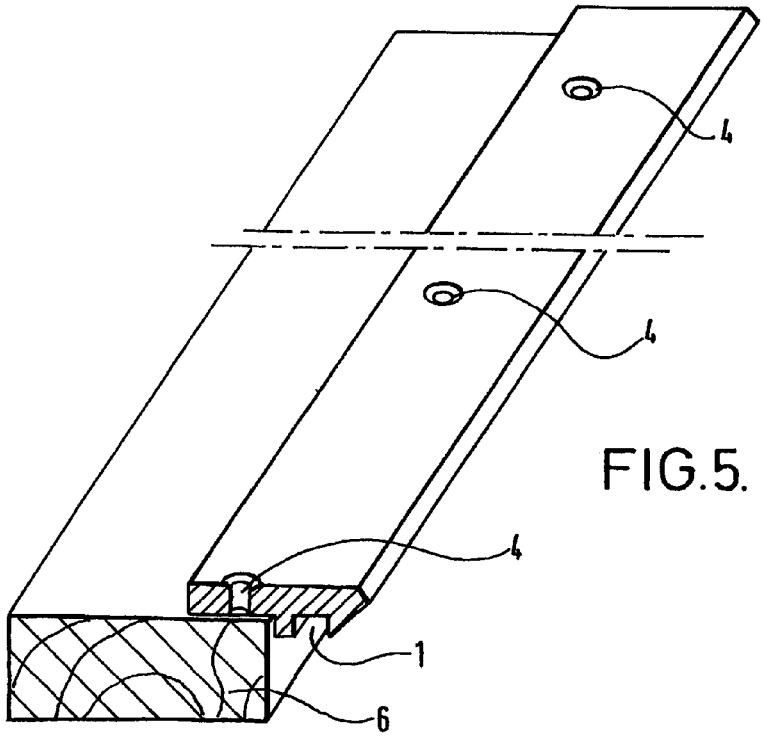

FIGS. 3*a* and 3*b* show a clip in elevation and plan respectively;

FIG. 4 shows a mounting arrangement of a batten rail directly on to a roof; and FIG. 5 shows the mounting arrangement of a batten rail on to a fixed batten of a building.

Referring to the drawings, an elongate fixing rail 1 is associated with a plurality of fixing clips 2, which are second by respective rivets 3 to the undersides of associated slates 5. In the first embodiment, the rail 1 is secured to battens 6 by means of wood screws 4. The battens sit on top of roofing felt 8, which covers a rafter or boarding 7 of the building.

Figure 1:
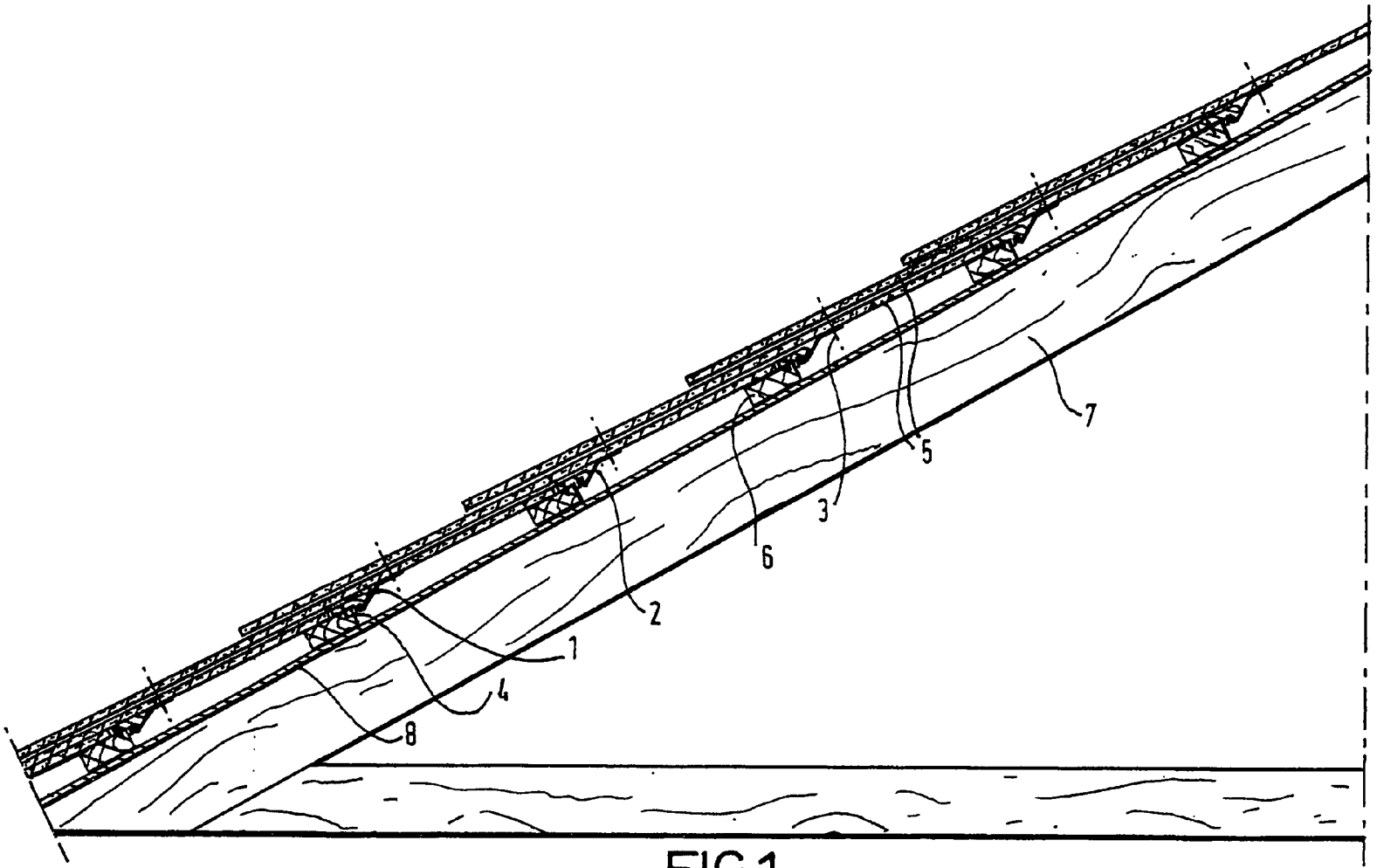
FIG. 1 is a vertical elevation of a plurality of rows of slates mounted on a roof.
Figure 2:
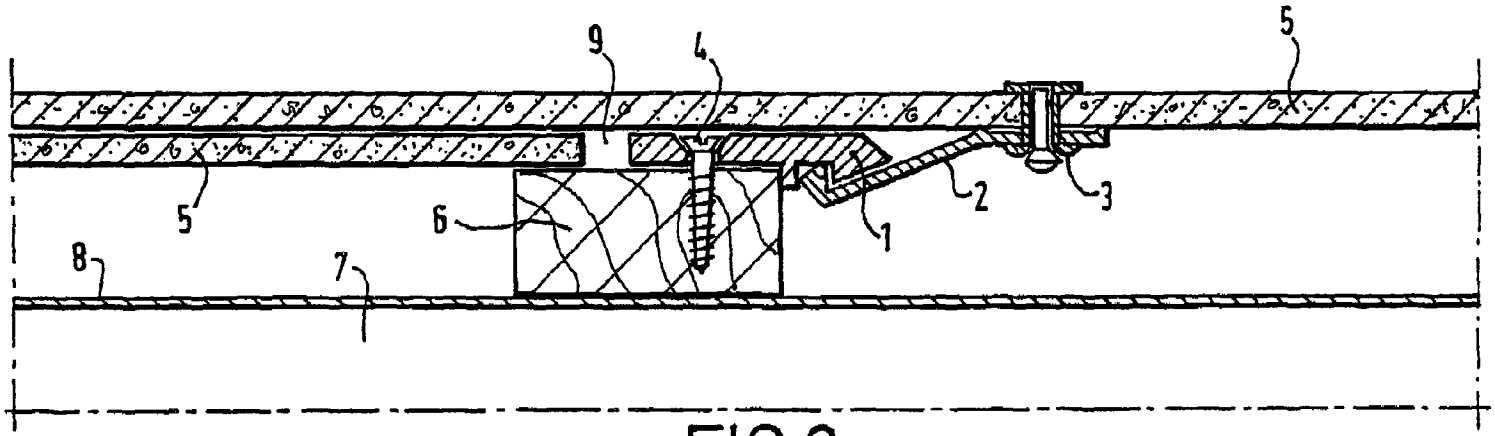
FIG. 2 is a detail of FIG. 1 showing the fixing of a clip to the slate and the clip to the roof.

The fixing rail 1 may be of generally planar construction as shown in FIGS. 1, 2 and 5, or alternatively may take the form 1*a* in the embodiment of FIG. 4, where it comprises a box section for mounting on to the rafter 7.

The rail 1, 1*a* has a groove 10 extending therealong, and each clip 1 has an upwardly-directed tongue 11 that can be clipped into the groove 10. The clip 2 is also provided with sharpened edges 12 in its upper surface so as to grip the underside of the slate 5 when riveted thereto, thereby to prevent relative rotation of the slate 5 about the clip 2.

As can be seen from FIG. 2, the clip 2 is secured to the underside of the slate 5 and its tongue 11 extends away therefrom. The portion of the clip 2 carrying the tongue 11 is preferably resilient, so that when the slate 5 is slide onto the fixing rail 1, the tongue 11 abuts the sloping surface of the edge of the groove 10 so that the tongue 11 slides thereover and clicks into place into groove 10 thereby securely retaining the slate 5 to the rail 1, and thus to the batten 6 and rafter 7.

As shown in FIGS. 1 and 2, the battens 6 are spaced apart along the roof so as to allow adjacent rows of slates 5 to overlap one another with a clearance gap 9 between the underlying slate 5 and the fixing rail 1 of an adjacent row of slates.

It will be appreciated that the resilient clip 2 and the snap fitting action into the groove 10 of the fixing rail 1, results in an audible click when the interlocking is effected. This indicates the proper mounting of the slate 5 on to the rafter 7.

It will be appreciated that the system also allows for expansion and contraction of the slates, while keeping them firmly secured to the roof.

The invention claimed is:

1. A slate laying system comprising:

an elongate batten rail for attachment to a building support member; and a clip fixedly attached to the underside of each slate of the system;

wherein the batten rail and the clips comprise a mechanical interlocking arrangement which enables each slate to be individually secured to the building support member independently of other slates; and wherein the interlocking arrangement comprises a groove that extends along the underside of the batten rail and a tongue of the clip for engagement therewith, such that each slate and clip, attached together, may be slid along the batten rail.

2. A slate laying system according to claim 1, wherein:

the or each clip has raised projections so as to grip the respective slate thereby to prevent rotation or slipping of the clip relative to the associated slate.

3. A slate laying system according to claim 1, wherein:

each associated clip and slate are riveted together.

4. A slate laying system according to claim 1, the system being for use on a sloping roof or substantially vertical wall.

5. A slate laying system according to claim 1, wherein:

the building support member comprises a rafter or a fixed batten of a roof.

6. A method of laying slates on a roof or facade of a building, comprising the steps of:

attaching an elongate batten rail to a building support member;

fixedly attaching clips to respective slates; and attaching the slates to the batten rail by means of the clips, the batten rail and the clips comprising a mechanical interlocking arrangement which, in use, enables each slate to be individually secured to the building support member independently of other slates; and wherein the interlocking arrangement comprises a groove that extends along the batten rail and a tongue of the clips that engage therewith, whereby after the batten rail and clips are interlocked, the slates may be slid into position by means of sliding the clips along the batten rail.

7. A method according to claim 6, wherein:

the slates are laid on a rafter or fixed batten of a sloping roof or substantially vertical wall.

* * * * *